United States Patent [19]

Florack et al.

[11] Patent Number: 4,977,430

[45] Date of Patent: Dec. 11, 1990

[54] TRANSFER ROLLER POWER SUPPLY

[75] Inventors: Christopher J. Florack, Rochester; William Y. Fowlkes, Brockport, both of N.Y.

[73] Assignee: Eastman Kodak Company, Rochester, N.Y.

[21] Appl. No.: 211,001

[22] Filed: Jun. 24, 1988

[51] Int. Cl.[5] ..... G03G 15/16

[52] U.S. Cl. ..... 355/274; 355/277

[58] Field of Search ..... 355/271, 273, 274, 275, 355/276, 277; 250/324, 325

[56] References Cited

U.S. PATENT DOCUMENTS

| | | | |
|---|---|---|---|
| 3,627,523 | 12/1971 | Shelffo | 355/271 X |
| 3,781,105 | 12/1973 | Meagher | 355/274 |
| 3,837,741 | 9/1974 | Spencer | 355/274 |
| 3,854,974 | 12/1974 | Sato et al. | 355/274 X |
| 3,924,943 | 12/1975 | Fletcher | 355/274 |
| 3,976,880 | 8/1976 | Brunelle et al. | 250/352 X |
| 4,338,017 | 7/1982 | Nishikawa | 355/274 X |
| 4,415,254 | 11/1983 | Nishikawa | 355/274 |

FOREIGN PATENT DOCUMENTS

| | | | |
|---|---|---|---|
| 56-35159 | 4/1981 | Japan | 355/277 |

*Primary Examiner*—Fred L. Braun

*Attorney, Agent, or Firm*—Milton S. Sales

[57] ABSTRACT

A power supply system for transfer rollers associated with electrostatographic marking engines. The power supply system includes a power source having a fixed and constant output parameter, such as current or voltage. Additional resistance is connected to the output of the power source to provide the most desirable bias level on the transfer roller under actual operting and material conditions. With a constant current source, a resistance is connected in parallel with the load impedance of the roller system. With a constant voltage source, the resistance is connected in series between the voltage source and the roller system.

2 Claims, 2 Drawing Sheets

TRANSFER ROLLER POWER SUPPLY

BACKGROUND OF THE INVENTION

1. Field of the Invention

This invention relates, in general, to electrostatic transfer of marking particle images from a substrate to a receiver member and, more specifically, to a power supply system for establishing a bias voltage on a transfer roller for the purpose of providing the desired electric field for quality electrostatic transfer of images.

2. Description of the Prior Art

In a conventional manner well known in the art of copiers, duplicators, printers, and the like, images are transferred to a receiving member, such as a sheet of paper, by an electrical potential difference between the image and the paper. The required electric field is often provided, especially in color applications, by a transfer roller which has been biased with an electrical voltage to generate the electric field. The power supply which biases the transfer roller is a critical component of a printing machine since the intensity of the electric field is essential to good image transfer and quality reproductions. One of the major problems lies in the fact that the resistivity of the transfer roller is highly dependent upon such things as the humidity, temperature, and roller composition.

Various arrangements have been used in the prior art to ultimately provide the desired electric transfer field by applying a specified voltage to the transfer roller. U.S. Pat. No. 3,837,741, issued Sept. 24, 1974 and assigned to Xerox Corporation, describes three methods of biasing a transfer roller. One method uses a constant current source to develop a voltage across a remote sample of the roller material. The developed voltage controls the output of another voltage power source which biases the transfer roller. A similar method disclosed in the referenced patent uses a roller sample actually mounted on the main roller shaft. The third disclosed arrangement tests the actual transfer roller intermittently at times when the roller is not transferring an image and storing information about the voltage needed to change the actual power source driving the transfer roller when it is functioning. While these methods may offer some advantages, they are determining bias levels based upon measurements which are removed from the actual roller bias application by either time or distance, thus allowing some margin of error.

It is therefore desirable, and it is an object of this invention, to provide a power supply system for biasing a transfer roller which gives an improved control of the electric field produced by the bias on the transfer roller. It is desirable to do this with the least amount of hardware practicable and that feature is also an object of the present invention.

SUMMARY OF THE INVENTION

There is disclosed herein a new and a useful power supply system for the transfer rollers of duplicating, printing, and similar electrostatic apparatus. The power supply system compensates for changes in the resistivity of the transfer roller due to temperature, humidity, and other conditions. The supply system provides the biasing voltage on the transfer roller to develop the proper electric field for good image transfer. As the resistivity of the transfer roller increases, the power supply system of this invention automatically compensates by increasing the voltage across the roller by an amount found to be ideal for good image transfer.

In one embodiment of the invention, a constant current source is paralleled with a fixed resistance and connected to the transfer roller. In another embodiment, a constant voltage source is connected through a fixed series resistor to the transfer roller. Either embodiment provides a very cost effective means, not known in the prior art, to determine a biasing level for the transfer rollers which gives results much better than using only fixed supplies and much more economical than more elaborate controlled voltage supply systems.

DESCRIPTION OF THE DRAWINGS

Further advantages and uses of this invention will become more apparent when considered in view of the following detailed description and drawings, in which.

DESCRIPTION OF THE PREFERRED EMBODIMENTS

Figure 1:
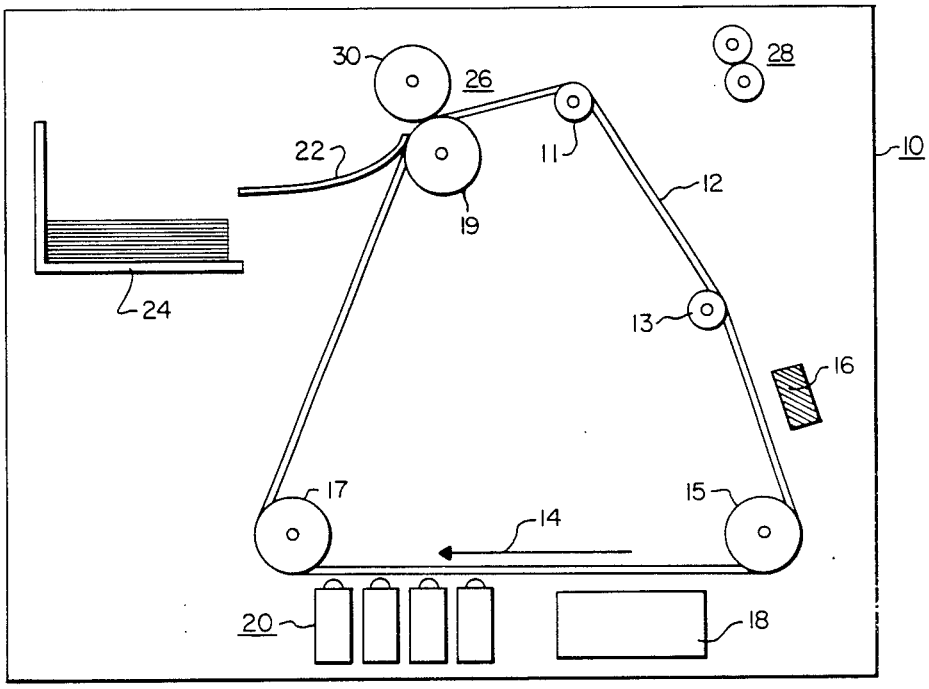
FIG. 1 is a schematic side elevational view of an electrostatographic marking engine which may utilize the present invention.

Throughout the following description, similar reference characters refer to similar elements or members in all of the Figures of the drawing.

Referring now to the drawings, and to FIG. 1 in particular, there is shown an electrostatographic marking engine of the type which can be used in copiers, printers, and duplicators. The marking engine 10 includes a dielectric substrate on an endless photoconductive belt 12 which is supported by rollers, such as rollers 11, 13, 15, 17 and 19, for movement around a closed path in the direction shown by arrow 14. A plurality of image areas on belt 12 move past a series of electrophotographic process stations, such as charging station 16, exposure station 18, and multi-color development station 20, to produce transferrable developed images in a manner well-known in the art.

Receiver members 22, often referred to as copy sheets or sheets of paper, are fed from a supply hopper 24 to a transfer station 26 in timed relationship with moving belt 12 so that the receiver members are in register with developed images on the belt 12. At transfer station 26, an electrical field is established between the receiver member 22 and the untransferred developed image that is sufficient to enable a transfer of the developed image from the belt 12 to the receiver member 22. After the transfer, the receiver member 22 is stripped from the belt 12 and is transported to a fuser assembly 28 where the transferred image is fixed to the receiver member 22. The transfer roller 30 is biased with an electrical voltage, as shown subsequently herein, to aid in the transfer of the image at station 26.

Figure 2:
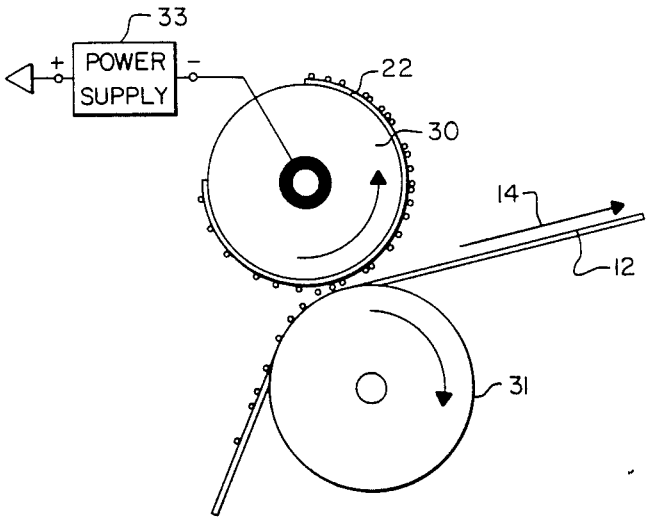
FIG. 2 is an enlarged schematic side view of the transfer nip region of the marking engine shown in FIG. 1.

The transfer station or region 26 is shown in enlarged schematic form in FIG. 2. According to FIG. 2, the belt 12 is moving in the direction 14 through rollers 30 and 31. When making composite color prints, it is necessary to successively register a single receiver member 22 to a plurality of successive image areas having differently colored developed images. The receiver member 22 is attached, in this preferred embodiment of the invention, to the transfer roller, or drum, 30. The transfer member 22 is repeatedly registered to develop color separation images on moving belt 12 until the total composite image is transferred. In a one-color process, the receiver member 22 may pass between rollers 30 and 31 only one time.

To enable the transfer of toned images that consist of electrostatically charged marking particles, an electrostatic bias voltage of opposite polarity as that of the marking particles is applied to roller 30 from an electrical power supply 33. In this embodiment, the negative potential of the power supply is applied to the roller 30. The electric field developed across the receiving member 22 due to the voltage from the power supply 33 causes the marking particles to transfer from the belt 22 to the receiver member 22 in a manner well-known to those skilled in the art.

Tests, experimentation, and experience has shown that the quality of the image transfer is highly dependent upon the electric field provided by the roller 30. Additionally, the electric field is dependent upon the resistivity of the material in the transfer roller 30, which can change due to ambient conditions such as temperature, humidity, and other factors. In order to compensate for the change in resistivity of the transfer roller 30, which is a part of the circuit supplied by the power supply 33, various arrangements have been used to apply the biasing voltage to the roller 30 as described in the prior art section hereof.

Figure 3:
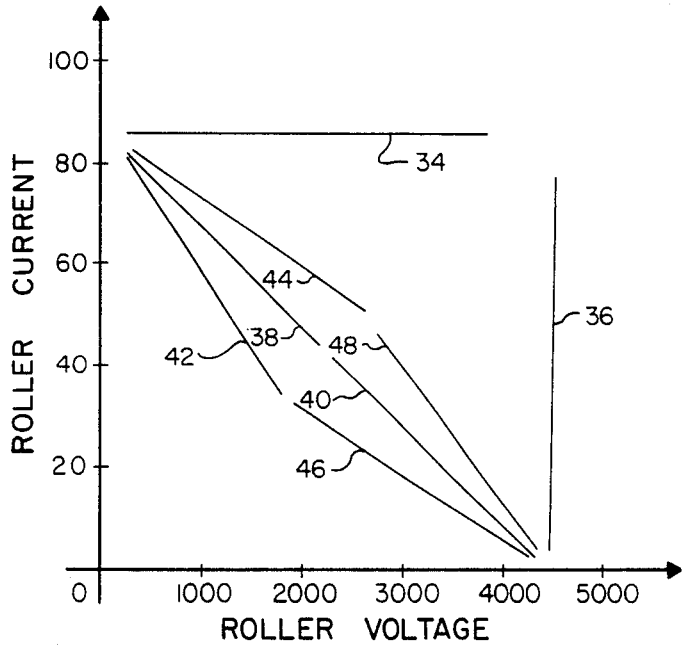
FIG. 3 is a graph depicting the voltage applied to the transfer roller with various supply sources and resistor values.

FIG. 3 is a graph illustrating the relationship between the current and voltage on the transfer roller 30 during the sampling process used to determine the desired bias. Attempts have been made to use constant voltage and constant current sources for the power supply 33 which provides the bias voltage for the transfer roller 30. Graphically, a constant current source would be represented by the line 34 in FIG. 3. According to such line, the current through the transfer roller remains the same, which is about 85 microamps according to FIG. 3. The current remains the same even though the resistivity of the transfer roller changes, therefore the voltage across the roller would change. While there is some advantage of having the voltage on the transfer roller 30 increase as the resistivity of the roller increases, the flat constant current line 34 of FIG. 3 does present some room for improvement, especially in multi-color transferring.

The line 36, also shown in FIG. 3, represents the case where the power supply 33 is of the constant voltage type. In this case, the voltage on the transfer roller 30 remains, in this example, 4,500 volts, regardless of any change in resistivity of the roller. In both the constant current and constant voltage methods, the electric field produced is not always ideal for quality transfer of the image to the receiving member, nor do they ideally compensate for resistivity changes.

Considerable testing and experimentation has shown that the best results are obtained when the power supply is biasing the transfer roller 30 to give neither a true constant voltage or constant current bias on the roller. Lines 38 and 40 shown in FIG. 3 represent such conditions. Lines 42, 44, 46 and 48 represent other supply characteristics which closely approach the desired criteria. The lines of FIG. 3 will be described in more detail with the aid of FIGS. 4 and 5.

Figure 4:
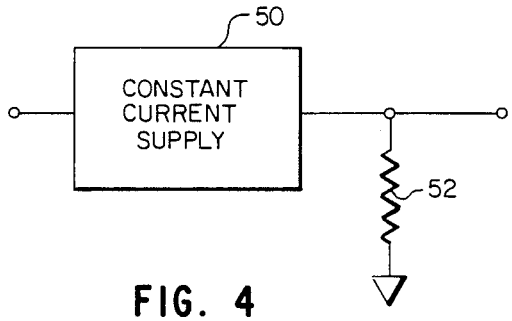
FIG. 4 is a schematic diagram of a constant current version of the invention.

FIG. 4 represents an embodiment of the invention wherein a constant current power supply 50 having the output thereof connected to ground through a resistor 52 comprises a portion of the power supply 33 shown in FIG. 2. In the constant current arrangement of FIG. 4, part of the current is shunted through the resistor 52 and part of the current from the current supply 50 flows through the transfer roller 30, to which it is connected. When the resistivity of the transfer roller increases, more of the current from the constant current supply travels through the resistor 52. On the other hand, when the resistivity of the transfer roller decreases, more of the constant current flows through the transfer roller 30, which is the desirable characteristic shown by experimentation and experience.

The exact line shown in FIG. 3 which represents the actual fluctuations depends upon the value of the resistor 52. Remembering that the lines of FIG. 3 represent the voltage applied to the transfer roller 30, line 42 represents the case when the resistance 52 is at a minimum, line 38 represents the transfer roller voltage when the resistor 52 is somewhat higher. Line 44 represents a case when the resistor 52 is still higher, and the line 34 represents the extreme case when the resistor 52 is at infinity. That is, when the constant current supply 50 is acting in the circuit as a pure constant current power supply. It is emphasized that the lines 34, 38, 42 and 44 of FIG. 3 are illustrated for various values of the resistance of the resistor 52. The actual operating point on any of the lines also depends upon the resistivity of the transfer roller 30 which is a part of the circuit through which the current from the current supply 50 flows. Therefore, the voltage developed on the roller 30 by the current flowing through the roller 30 can be determined by the particular line in FIG. 3 which is appropriate for the resistor 52.

Experimentation and tests have shown that the electric field required in the transfer operation is best provided when the current from the constant current supply 50 is between 80 and 85 microamps, and when the resistance 52 is approximately 48 megohms. The actual current of the supply 50 depends somewhat on the elevation of the machine in operation, with the 80 microamp figure being more desirable at higher altitudes, such as at 5,000 feet, and the higher current of 85 microamps being more optimum at sea level conditions. On the other hand, some changes in the overall parameters of the machine may make it desirable to have different operating values than those previously stated. However, in nearly all cases, the optimum performance can be obtained from the constant current supply embodiment shown in FIG. 4 with a current output from the supply between 60 and 100 microamps, and a resistance of the resistor 52 between 35 and 70 megohms.

Figure 5:
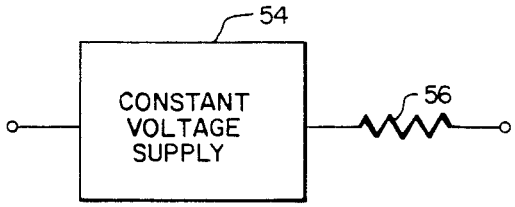
FIG. 5 is a schematic diagram of a constant voltage version of the invention.

FIG. 5 illustrates another embodiment of the invention wherein a constant voltage supply 54 and a resistor 56 are used for a portion of the power supply 33 shown in FIG. 2. In the embodiment of FIG. 5, the resistor 56 is in series with the resistance of the transfer roller 30. In such case, the lines 36, 40, 46 and 48 of FIG. 3 are pertinent. Line 36 represents the case where the resistance of the resistor 56 is zero. Line 40 represents a line along which the roller voltage can be determined for a finite resistance value of resistor 56, and lines 46 and 48 represent other lines for resistance values of resistor 56 which are greater than or less than, respectively, the resistance which established line 40. In other words, depending upon the value of the resistance of resistor 56, lines similar to lines 40, 46 and 48 could be used to determine the voltage applied to the roller 30 under different conditions of roller resistivity.

Calculations have shown that the optimum electric field established by the roller 30 would be produced when the output of the supply 54 is 4,500 volts and the resistance of the resistor 56 is approximately 50 megohms. In any event, other factors in the operation of the machine still dictate that the supply voltage 54 should be between 3,500 and 5,000 volts, and that the resistor 56 should have a resistance between 35 and 70 megohms.

It is emphasized that the constant current and voltage supplies described herein are used to determine the proper bias voltage for the present roller conditions. For example, even though the supply 33 may be operating as a constant current source with a shunt resistor for establishing the optimum bias voltage, the supply 33 would function as a controlled voltage supply for providing the actual bias during transfer. FIG. 3 of the referenced patent illustrates one method of controlling the bias based upon a constant current sampling system.

There has been disclosed herein a unique and novel arrangement for developing a condition responsive bias voltage on transfer rollers of copying and printing machines. Because of its easy implementation and determination of component values, it is considered very useful and an important advance in the art.

It is emphasized that numerous changes may be made in the above-described apparatus without departing from the teachings of the invention. It is intended that all of the matter contained in the foregoing description, or shown in the accompanying drawings, shall be interpreted as illustrative rather than limiting.

We claim:

1. Apparatus for determining the bias voltage for a transfer member in an electrostatographic marking engine, said apparatus comprising:

a constant current power supply having an output terminal and a fixed output between the range of 60 and 100 microamps;

means for electrically connecting the output terminal of the constant current power supply to the transfer member; and a resistance element connected in parallel with the transfer member for reducing the amount of the constant current from the power supply which is applied to the transfer member.

2. Apparatus for determining the bias voltage for a transfer roller of a copying-printing machine, said apparatus comprising:

a two-terminal constant current power supply having a fixed output of between 60 and 100 microamps;

a resistance element having a resistance between 35 and 70 megohms, said resistance element being connected between the two terminals of the power supply; and means for connecting the power supply to the transfer roller, thereby effectively paralleling the resistance of the transfer roller with said resistance element.

* * * * *